United States Patent [19]

Ratner

[11] Patent Number: 4,796,883

[45] Date of Patent: Jan. 10, 1989

[54] METHOD AND APPARATUS FOR JUGGLING

[76] Inventor: Harvey Ratner, 2905 Red Lion Lane, Silver Spring, Md. 20914

[21] Appl. No.: 940,415

[22] Filed: Dec. 11, 1986

[51] Int. Cl.[4] ..... A63B 67/00; A61B 3/00

[52] U.S. Cl. ..... 272/93; 272/124; 273/1 GE; 273/318; 273/428; 351/201; 351/203

[58] Field of Search ..... 273/1 G, 1 GE, 327, 273/428, 318; 446/240, 255, 266, 34; 272/122, 124, 93, 95, 128, ; 351/201-203; 84/477 B, 272, 273, 446

[56] References Cited

U.S. PATENT DOCUMENTS

| | | | |
|---|---|---|---|
| 2,213,467 | 9/1940 | Greenspoon | 351/203 |
| 2,523,007 | 9/1950 | Glazer | 351/202 |
| 4,458,896 | 7/1984 | Solloway | 272/116 |
| 4,623,142 | 11/1986 | MacKechnie | 272/116 |
| 4,750,745 | 6/1988 | Benham | 273/327 |

FOREIGN PATENT DOCUMENTS

| | | | |
|---|---|---|---|
| 1601665 | 10/1970 | France | 273/428 |
| 12250 | 4/1895 | United Kingdom | 272/123 |
| 257959 | 12/1926 | United Kingdom | 272/124 |
| 446726 | 5/1936 | United Kingdom | 272/124 |
| 2080122 | 2/1982 | United Kingdom | 273/428 |

OTHER PUBLICATIONS

Aug. 1959, "Playthings" Magazine Advertisement for Twirl-Aton Toy 1984-Advertisement for Quix Stix Toy.

*Primary Examiner*—Richard J. Apley
*Assistant Examiner*—Franklin L. Gubernick
*Attorney, Agent, or Firm*—Epstein & Edell

[57] ABSTRACT

An amusement device, useful for ocular as well as hand-eye coordination exercises, takes the form of a rod with two removable end balls and a positionally adjustable intermediate ball. The rod is manipulated, twirled and juggled by means of two hand-held juggling wands in a variety of ways to effect different exercises. The balls are visibly distinguishable, preferably by color, to permit a user to focus on a specific ball while the rod is twirling and to catch the rod with that ball in a prescribed orientation. The adjustable ball permits selective adjustment of the center of gravity of the rod and correspondingly adjusts the rod trajectory so as to increase and decrease the difficulty of each exercise. One or more individuals can use the juggled rod, each holding a pair of juggling wands.

9 Claims, 3 Drawing Sheets

METHOD AND APPARATUS FOR JUGGLING

BACKGROUND OF THE INVENTION

1. Technical Field

The present invention relates to an amusement device and methods of its use which provide visual skill exercise and training as well as hand-eye coordination exercise and training. In particular, the present invention relates to amusement devices of the general type in which an elongated rod is manipulated, tossed and/or juggled with the aid of two hand-held wands. The device may be used by one person or two or more persons, each holding a pair of wands.

2. Discussion of the Prior Art

It is known in the prior art to juggle a rod with the use of a pair of hand-held wands. For example, U.S. Pat. No. 4,118,030 (Randon) discloses a lightweight tube which can be juggled by means of similar tubes (i.e., wands) having a relatively high-friction cushioning cover. The high-friction covers permit the juggled tube to be readily caught and grasped anywhere along the length of the juggled tube and also reduce the tendency of the juggled tube to bounce when caught in a horizontal orientation. While a device of this type permits development of one's juggling skill, the uniformity and symmetry of the juggled tube results in a readily predictable uniform trajectory when the tube is tossed and twirled, thereby limiting the variety of available juggling routines. As a consequence, the scope of exercises and hand-eye training routines available to the user is quite limited. Further, since the juggled tube is visibly uniform and can be caught at any point along its length, a user of the device can not visibly distinguish particular points along the length of the tube as it is being twirled in the air. The ability to so distinguish is important in certain aspects of hand-eye coordination, training and exercise as described herein.

In U.S. Pat. No. 2,364,137 (Gibb) there is disclosed a rod having a frusto-conical enlargement projecting radially therefrom at a location intermediate the rod midpoint and one of the rod ends. The surface of the enlargement is made of relatively high-friction material to enable it to be controllably struck by individual hand-held sticks so as to maintain the rod in flight by batting it with a series of impacting strikes on the enlargement. The off-center location of the enlarged projection causes the in-flight rod to have a rocking type trajectory to which a user may adapt; however, the fixed longitudinal position of the projection limits such trajectory to a single type to which a user may readily adapt over time. The non-uniformity of the rod contour provided by this enlarged projection permits a user to focus on, and attempt to strike, that projection when the rod is in flight and thereby exercise his/her hand-eye coordination. However, the fixed location of the projection limits the extent of such exercise. In addition, the Gibb patent describes only a mode of use whereby the rod is struck to maintain it in flight, and does not suggest that the rod may be juggled (i.e., grasped, tossed/-twirled and caught in repetitive cycles). It is juggling, not striking, to which the method aspects of the present invention are directed so as to improve hand-eye coordination for reasons described herein below.

A twirlable amusement device disclosed in U.S. Pat. No. 3,528,659 (Benham) includes a shaft having two cup-like members disposed at its opposite ends with their open ends facing one another. A single hand-held stick is used to twirl the rod in a vertical plane by imparting appropriate rotational force to the rod at the juncture of the rod and one of the end cups. Although use of the device in this manner develops some degree of dexterity in the user, the trajectory of the twirled rod is always the same because of its end-to-end uniformity between the end cups. Moreover, since the end cups are substantially identical, it is impossible for a user to focus on a specific end cup while the rod is in twirling flight so as to attempt to catch the twirling rod by that specific end cup.

Other prior art twirlable or juggled devices of general interest may be found in U.S. Pat. Nos. 3,106,039 (Simpson), 1,285,642 (Restein); and 2,167,992 (Olsen).

I am aware of a prior art device in which a juggled rod has two spherical members secured to its opposite ends. The rod has a smooth low-friction surface and is juggled by means of two hand-held wands of smooth-low-friction material. The rod can be supported in a horizontal orientation by permitting it to rest on the two wands. Alternatively, the rod can be caught and grasped in a vertical orientation between the two wands at the juncture of the rod and either end ball. In this device the center of gravity of the rod is fixed at its longitudinal center so that the twirling trajectory is always uniform and the same. Moreover, since the end balls are visibly identical, the user can not readily focus on one of the balls while the rod is twirling so as to attempt to catch the rod adjacent that ball.

OBJECTS AND SUMMARY OF THE INVENTION

It is an object of the present invention to provide an amusement device and methods of using such device which permit the user to improve visual skills and hand-eye coordination and additionally permit exercise of ocular muscles.

It is another object of the present invention to provide a device of the type described wherein a juggled rod can have its center of gravity longitudinally adjusted so as to permit selective adjustment of the trajectory of the twirling motion of the rod.

Still another object of the present invention is to provide an amusement device wherein a juggled rod is capable of being caught between two hand-held wands at any of a plurality of different locations along the rod length which are visibly demarked so as to be distinguishable from one another while the rod is being twirled.

It is a further object of the present invention to provide a variety of different exercises involving the use of a rod juggled from between two hand-held wands, to improve visual capabilities and hand-eye coordination of the user.

Another object of the present invention is to provide an amusement device of the type described which is useful for vision testing and training whether or not it is used for juggling.

A still further object of the present invention is to provide a juggling type amusement device of the nature generally described hereinabove which can be used by one person or a plurality of people simultaneously while providing the exercise and training benefits for all of the users.

It is another object of the present invention to provide a juggled rod having at least two visibly distinguishable projections to permit a juggler to focus on one of the projections when attempting to catch the rod at that projection.

In accordance with the present invention a juggled rod is fabricated of lightweight low-friction material and has first and second balls secured at its ends. A third ball is slidably mounted on the rod so as to be positionable at any point along the rod length between the two end balls. Each of the three balls is preferably hollow with multiple apertures defined therein. The slidable ball, according to one feature of the present invention, is positionable as desired along the rod length to change the center of the gravity of the rod and thereby permit variation of the trajectory or eccentricity of spin or revolution of the rod when it is twirled. To effect twirling the rod may be supported or grasped between two hand-held wands of low-friction material which may support the rod horizontally (with the wands separated) or vertically (when the wands are brought together on appropriate sides of the rod below and in contact with one of the balls). The low-friction materials of the rod and wands cause the rod, when supported vertically, to slip, under the influence of its own weight, downward until the bottom of one of the balls serves as a stop on the two supporting wands.

According to a second feature of the present invention, the two end balls are visibly distinguishable from one another (e.g., by color) so that when the rod is twirling a user can focus on a selected ball and attempt to catch the rod at its juncture with that ball. In instances where the rod is to be caught in a horizontal orientation, the user can focus on one of the balls to attempt a catch with a specific ball at his/her right hand side or left hand side, as predetermined. In a broader aspect of this inventive feature, the slidable ball may be eliminated, leaving only the two end balls of different visible characteristics. However, the preferred form of the invention includes the slidable ball to permit selective variation of the center of gravity and, thereby, the pattern of movement of the twirled rod, in addition to the option of focusing on any one of the three differently colored balls.

The rod with its slidable ball may also be used for a number of ocular testing and exercise procedures without being juggled.

BRIEF DESCRIPTION OF THE DRAWINGS

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein.

DESCRIPTION OF THE PREFERRED EMBODIMENTS

Figure 1:
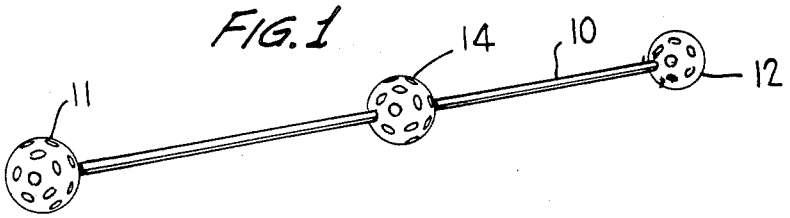
FIG. 1 is a view in perspective of a rod assembly constructed in accordance with the present invention.
Figure 2:
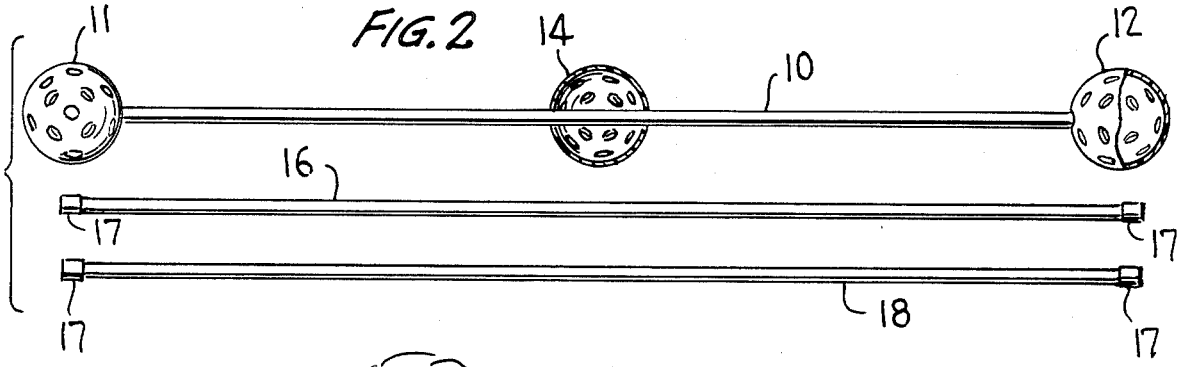
FIG. 2 is a top view in plan of the rod assembly of FIG. 1 and two wands used in juggling the rod.

Referring specifically to FIGS. 1 and 2 of the accompanying drawings, a rod 10 of hard, substantially rigid, plastic (e.g., polyvinylchloride, suitable acrylic, etc.) or other lightweight, low-friction material has end balls 11, 12 secured at its opposite ends. Rod 10, in the preferred embodiment, is a hollow smooth-surfaced extruded cylindrical tube which, when in contact with a tube of similar material, has a very low sliding coefficient of friction (i.e., a coefficient of friction on the order of that of glass on glass, or lower). Although rod 10 need not be cylindrical (e.g., it may have an oval or polygonal transverse cross-section), the cylindrical configuration is preferred. The rod is substantially rigid in the sense that it may be supported horizontally at one or both ends without transversely collapsing or flexing from its own weight or from the weight of an intermediate ball supported thereon in the manner described below.

The two end balls 11 and 12 are hollow and also preferably made of lightweight plastic material which has multiple apertures. Such balls are commonly sold under the tradename "Whiffleball". The balls 11 and 12 are preferably secured to the rod such that the rod ends terminate within the hollow ball interior. In this regard the rod is tightly engaged in one of the apertures of each ball and is held in place by a tight friction fit, or in some cases, may be held by adhesive material applied at the junction of the rod periphery and the ball aperture. It is within the scope of the present invention to permit the rod to be slidably removed from the end balls to replace the rod or balls as desired; however, in the preferred embodiment the rod is not readily removable from within the end balls. The overall weight of the rod 10 and the two end balls 11, 12 is sufficiently light to permit the unit to be easily supported, tossed and twirled by children as young as two or three years old.

An important feature of the rod assembly as thus far described is the fact that end balls 11 and 12 are visibly distinguishable from one another by something other than their positions at different ends of the rod. That is to say, if rod 10 is twirled end-over-end, the end balls 11 and 12 must be individually distinguishable from one another in flight. To this end I provide end ball 11 in a different color than that of end ball 12. For example, end ball 11 may be yellow whereas end ball 12 may be red. A juggler (i.e., user of the device) can then readily focus on one or the other of the two end balls while the rod is twirling and attempt to catch the rod (in the manner described below) at its juncture with the selected ball. This involves a markedly different set of skills (i.e., ocular tracking) and hand-eye coordination than is required to simply catch the twirling rod without specifiying a particular location on the rod at which it is to be caught. Although color differential is the easiest technique for rendering end balls 11 and 12 visibly distinguishable, other visibly distinguishable characteristics may be employed, such as shape (e.g., a ball versus a cube), size, etc.

Rod 10 and end balls 11 and 12 are preferably selected such that the center of gravity of the rod assembly is substantially at the longitudinal midpoint of the rod. This permits the rod to be balanced from its longitudinal center and to be twirled endover-end without exhibiting eccentricity of motion. In order to permit selective variation of this motion in accordance with another feature of the present invention, a third or intermediate ball 14 is slidably disposed on rod 10 intermediate end balls 11 and 12. Slidable intermediate ball 14 is also preferably a hollow ball with multiple apertures of the same general type as end balls 11, 12 and is rendered slidable on rod 10 by virtue of the rod projecting through two diametrically opposite apertures in the ball. In this regard, the friction fit between rod 10 and the apertures in ball 14 should permit the ball to be readily moved to any position along the rod length by a user of the device, but must retain the ball in the desired position when the rod is twirled and caught and when ball 14 is impacted by the juggling wands (described below) during juggling or other normal use. Slidable ball 14, in the preferred embodiment, is visibly distinguishable from end balls 11 and 12 by other than its position on the rod. Preferably, it is the color of ball 14 which visibly distinguishes it from end balls 11 and 12. For example, if end ball 11 is yellow, and end ball 12 is red, slidable ball 14 may be blue or white. As a general rule, although not critical for the present invention, it is desirable that all three balls have colors different from the color of rod 10.

In order to juggle the rod assembly, a pair of substantially identical juggling wands 16 and 18 are provided and adapted to be held in respective hands of the individual juggler. As is described below, if more than one person is using the juggling rod 10 at one time, each such person is provided with a pair of hand-held wands 16, 18. The wands are preferably hollow tubes of the same smooth-surfaced, low-friction plastic material used for rod 10. Plastic caps 17 are disposed at opposite ends of the wands to cover any exposed rought edges. Although the preferred configuration of wands 16 and 18 is cylindrical, various configurations may be employed, if desired, such configurations being similar to those discussed above for rod 10. In addition, although balls are preferable for end objects 11 and 12 and intermediate object 14, other configurations may likewise be used as long as they are consistent with the functional requirements set forth below.

For purposes of illustration only, and to provide some frame of dimensional reference for the reader, a rod 10 capable of being used by a typical adult might have a length of twenty-seven inches, although lengths in the range of eighteen inches to thirty-six inches, and beyond, are certainly useful. Likewise, wands 16, 18 are preferably twenty-four inches long but may vary considerably. The tubes from which the rod 10 and wands 16, 18 are made preferably have an outer diameter in the range of one-half to three-fourths of an inch with a material thickness on the order of one-eighth to three-sixteenths of an inch. Balls 11, 12 and 14 have a diameter which is typically in the range from two and one-half to three and one-half inches, although this range can be varied considerably. In this regard it should be noted that smaller balls render the use of the device more difficult so that it may be disirable to provide interchangeable balls of different sizes. The apertures in the balls are sized according to the requirements described above for engaging rod 10, and depend upon the outside diameter of that rod.

Figure 3:
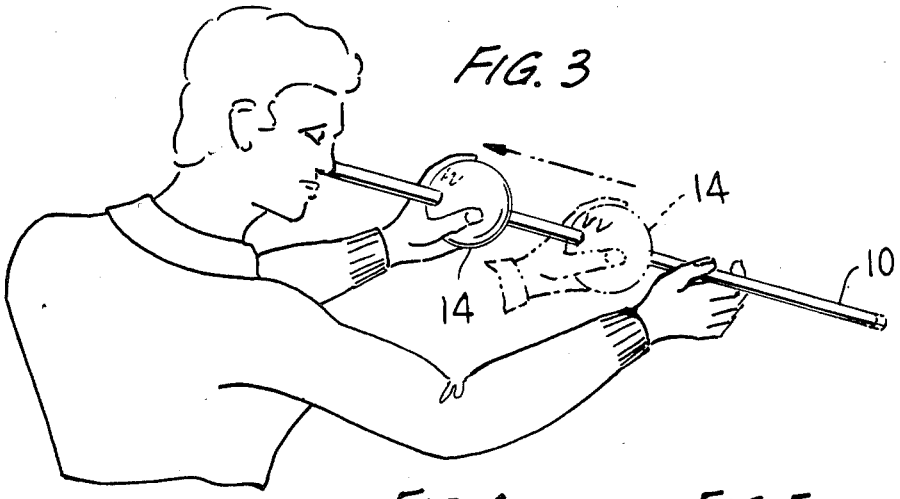
FIG. 3 is a view in perspective showing a patient utilizing the rod of FIG. 1 as part of an ocular exercise.
Figure 4:
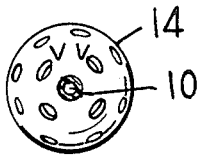
FIG. 4 is a view of a ball that is slidably mounted on the rod of FIG. 1 as seen by the patient at one stage of the exercise illustrated in FIG. 3.
Figure 5:
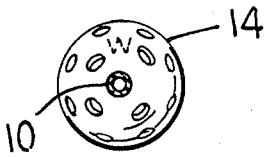
FIG. 5 is a view of the ball of FIG. 4 as viewed by the patient during another stage of the exercise illustrated in FIG. 3.

Apart from its use as a juggling device (as described below), rod 10 may be used to test and exercise various ocular capabilities of a user. For example, reference is now made to FIGS. 3, 4 and 5 wherein rod 10 is shown along with slidable ball 14 but with end balls 11 and 12 removed. It should be noted that this exercise can be, and typically is, performed without removing the end balls but, for purposes of simplifying this description, the end balls are not shown in FIG. 3. The patient/user holds the rod 10 with one end at his/her nose so that the rod projects away from the patient and is centered with respect to the patient's eye. On the hemisphere of slidable ball 14 which faces the patient there are printed two spaced characters such as the letters "V". Ball 14 is rotated about the rod until these letters are positioned above the rod 10 and on opposite sides of the rod so that one letter is on the same side as the patient's left eye while the other letter is on the same side as the patient's right eye. In this position the patient may be tested for his/her: (1) Fusional Convergence Reserve, which is the compensatory function used to voercome exophoria (i.e., the tendency of the eyes to diverge); and (2) Fusional Divergence Reserve, which is the compensatory function used to overcome esophoria (i.e., the tendency of the eye to cross). The patient initially slides ball 14 as far away from his/her eyes as the hand holding that ball will reach, and focuses both eyes on a spot on the ball midway between the two "V" characters. The two characters should appear as separate characters, as illustrated in FIG. 4. Ball 14 is then moved along rod 10 while the patient maintains both eyes focused at the spot on the ball midway between the characters. At some point during this movement of the ball the characters should appear to the patient as having merged, as illustrated in FIG. 5. Typically, this should take place when the ball is spaced somewhere between onehalf inch and three inches away from the patient. Continued movement of the ball toward the patient results in an apparent cross-over of the characters such that the right eye sees the left"V" and the left eye sees the right"V". The ball is then slid away from the patient so that these visual perceptions repeat in opposite order. By repeating the exercise, as needed, a patient should be able to increase the distance from his/her eyes at which the convergence of the"V" characters occur. It should also be noted that the function ascribed to the two"V" characters may alternatively be performed by two apertures in the ball 14, thereby eliminating the need for printing the characters on the ball.

In addition to convergence/divergence training and exercise, a patient may use rod 10 for focus change (i.e., ocular accommodation) training and exercise. In this exercise the rod 10, with all three balls 11, 12 and 14 disposed thereon, is placed in the same position illustrated in FIG. 3 (i.e., with end ball 11 abutting the patient's nose). Slidable ball 14 is placed in close proximity to the patient's nose and the patient quickly alternates his/her vision focus between the slidable ball 14 and the far end ball 12. The patient may also use a remote object (i.e., not on rod 10) as one point from which his/her focus is alternated.

Figure 6:
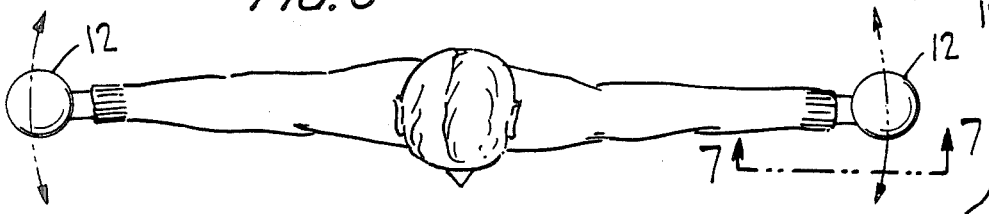
FIG. 6 is a diagrammatic illustration of still another ocular exercise that can be performed with the rod of FIG. 1.
Figure 7:
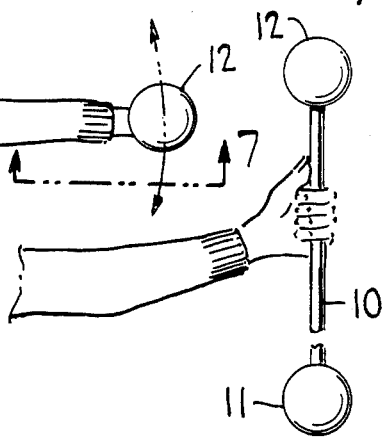
FIG. 7 is a view in elevation taken along lines 7—7 of FIG. 6.

Peripheral vision may also be tested, exercised and monitored with rod 10 is conjunction with the differently colored end balls 11, 12 in the manner illustrated in FIGS. 6 and 7. The patient initially places the unit behind his/her back and revolves the rod a number of times until, with the rod oriented vertically, the patient no longer remembers which of the colored end balls 11, 12 is at the top of the rod. Then, staring straight ahead (i.e., focusing on a distant object) the patient slowly brings the substantially vertically oriented rod around from behind his/her back with his/her arm fully extended and the upper of the two end balls 11, 12 at a desired height, for example, at eye level. The angular orientation (i.e., relative to the straight ahead focus direction) of the upper end ball when the patient first recognizes the color of that ball is a measure of the patient's peripheral vision. The exercise can be performed by either eye by holding the rod in the appropriate hand and can, be repetition, effect measurable improvement in the patient's peripheral vision. The exercise may also be performed by recognizing the lower ball, and the vertically oriented rod can be held at a variety of different heights relative to eye level.

A patient's saccadic capability (i.e., the ability to move one's eye rapidly to focus in different directions) can be measured by holding the rod 10 in front of the patient and requiring that he/she alternate focus on one of balls 11, 12 or 14 and then another of the balls in rapid succession without movement of the patient's head. In this exercise the rod may be oriented horizontally, vertically, or at any orientation between the two. The patient can be required to call out the colors of each ball as he/she focuses on it, or a trainer/physician may call out the colors in rapid succession and require the patient to focus on the ball of corresponding color. Repeated use of the exercise should permit the user to increase the rate of speed at which he/she can change focus direction.

Apart from the saccadic ocular testing exercise described above, the present invention is primarily intended to test handeye coordination in a dynamic juggling-type mode. There are numerous types of exercises that can be performed using the rod 10 (with balls 11, 12 and 14) and wands 16 and 18, only a few of which are described herein. Each of the exercises can be used to test and exercise a different area of hand-eye coordination and dexterity.

Figure 8:
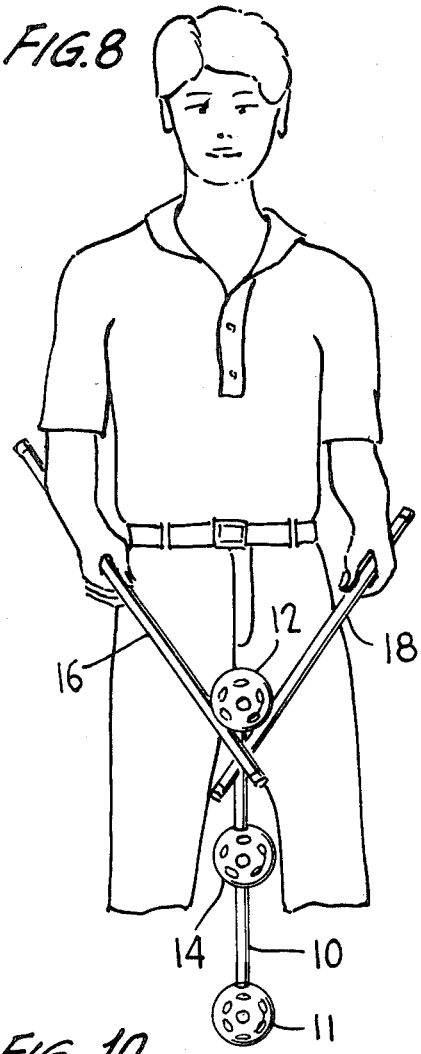
FIG. 8 is a view in elevation showing one position in which the rod of FIG. 1 may be vertically supported by the hand-held wands as part of a plurality of different exercises capable of being performed as part of the present invention.
Figure 9:
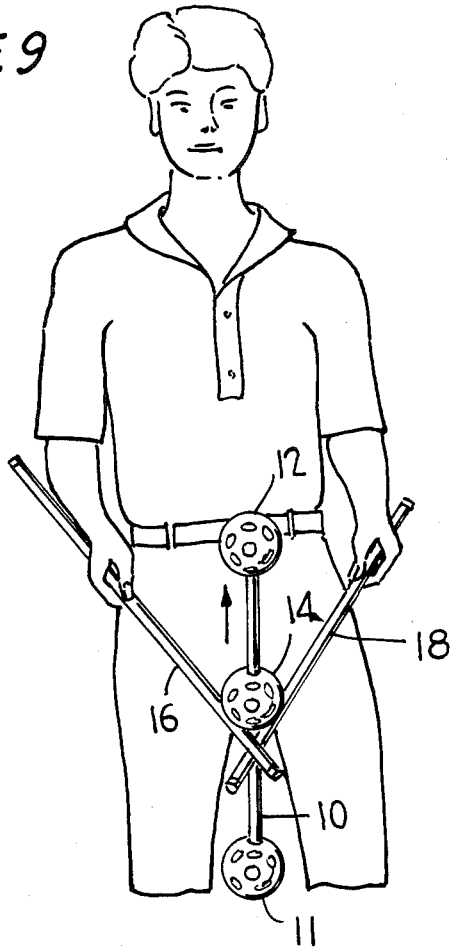
FIG. 9 is a view in elevation of the rod of FIG. 1 supported in a second vertical position as part of a plurality of different exercises that can be performed as part of the present invention.

Referring specifically to FIG. 8, a first position is illustrated from which a variety of different exercises may be performed. The user, holding wands 16 and 18 in his/her hands, grasps the vertically oriented rod 10 between the wands at the juncture of the rod and the upper end ball 12 so that ball 12 rests on the wands. From this position ball 12 and rod 10 may be flipped vertically upward so that the user can catch rod 10 at its juncture with the underside of slidable intermediate ball 14, as illustrated in FIG. 9. The user can then drop the rod and catch it once again just below end ball 12 to return to the starting position illustrated in FIG. 8. Rapid alternation between these two positions constitutes a relatively simple exercise that permits the user to gradually become proficient in using wands 16, 18 to catch rod 10 immediately below one of the balls. Initially, slidable ball 14 may be located at the longitudinal midpoint of rod 14. As the user becomes more proficient, the slidable ball may be positioned closer to one of the end balls, for example upper end ball 12 to shorten the length of exposed rod between the two balls. This forces the user to catch the rod right at the ball 12, rather than catching it intermediate the balls and then permitting the rod to slide downwardly until the end ball stops on the wands. In addition, relocation of slidable ball 14 either further from or closer to the top of end ball 12 changes the symmetry and balance of rod 10 and likewise forces the user to accommodate the greater tendency of the rod to tilt when ball 14 is engaged (see FIG. 9) at a location closer to the bottom ball 11. This greater tendency towards tilt of the rod requires the user to move more quickly in switching the wands to the top ball (FIG. 8) position, in which it is more stable, rather than attempting to hold the rod vertically still in the position illustrated in FIG. 9.

The position illustrated in FIG. 8 may also serve as the starting position for an exercise whereby the suspended rod 10 may be tossed from wand 16 to wand 18 and back, repeatedly, with the wands individually engaging the rod and the bottom of the upper end ball 12. Movement of the rod during this exercise is similar to that of an inverted pendulum. The trajectory of top end ball 12 during this exercise is dependent upon the position of the slidable ball 14 along the length of rod 10. When ball 14 is positioned closer to the top end ball 12, the arc of displacement of end ball 12 for a given force (i.e., a throw from one want to the other) is shorter, whereas the arc length increases as ball 14 is moved closer to the bottom of the rod. Moreover, as the arc increases, ball 12 moves faster during its trajectory. The user can thus gain hand-eye training during this exercise using a variety of speeds of rod 10 as well as different degrees of rod movement. This same exercise can be performed by catching the intermediate or slidable ball 14 at its juncture with rod 10, using the FIG. 9 position as the starting position. When so performed, the exercise becomes increasingly difficult as the slidable ball 14 is moved downward toward lower end ball 11 since the throwing force is exerted below the center of gravity of the rod and therefore tends to cause the rod to revolve or turn in a direction opposite to that brought about when the upper end of the rod is caught and thrown.

Figure 11:
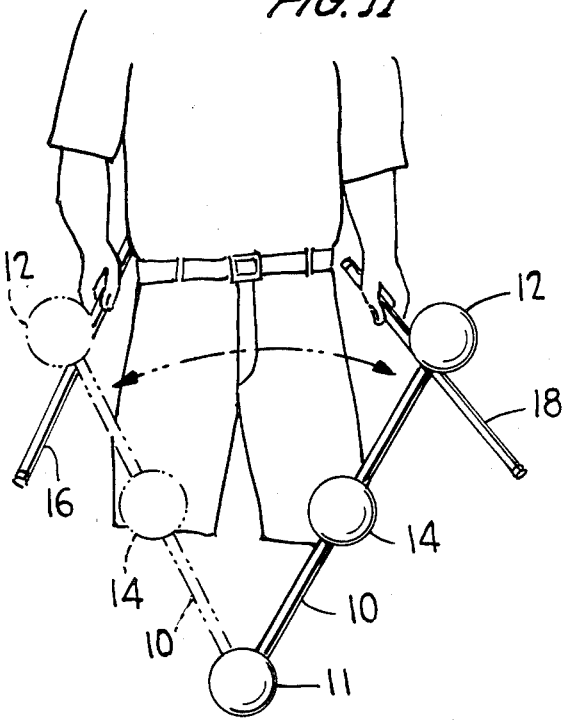
FIG. 11 is a diagrammatic illustration of still another exercise performed in accordance with the present invention using the rod of FIG. 1.

The exercise diagrammatically illustrated in FIG. 11 is similar to that described above, but in this instance the lower end ball 11 is supported on the ground or other surface, and the rod is pivoted about that supported ball by pushing the upper end ball 12, or the slidable ball 14, between the two wands 16, 18. Again, the position of slidable ball 14 affects the speed and degree of movement of the rod itself and of the upper end ball 12 so as to permit selective variation of the degree of difficulty of the exercise. In both of these exercises (i.e., the lower end ball suspended, or the lower end ball supported on a surface) the user may switch from catching the upper end ball 12 to catching the slidable ball 14, either on a random basis, or in accordance with a prescribed program, or in response to oral commands from a trainer or therapist.

The positions illustrated in FIGS. 8 and 9 may also serve as the starting positions for an exercise whereby the rod is twirled and permitted to do one or more half revolutions (i.e., one hundred eighty degrees, three hundred sixty degrees, five hundred forty degrees, etc.) before being caught in either of the starting positions. In order to effect the twirling motion, the user merely swings the suspended lower portion of the rod, including the lower end ball, and then tosses the rod up into the air to a height appropriate to permit the desired number of revolutions. The object of the exercise is to visually follow a preselected ball 11, 12 or 14 by its color as the rod is twirled, and then catch that ball in the position illustrated in FIGS. 8 or 9, as determined in advance. When slidable ball 14 is longitudinally centered on rod 10, the revolutions are uniform in that the two end balls revolve about the longitudinal center of the rod. If slidable ball 14 is off the longitudinal center, the revolutions become eccentric, the eccentricity increasing with the displacement of the slidable ball from the longitudinal center of the rod. Again, the ball to be caught during the twirl, may be random, or according to a prescribed program sequence, or in response to a trainer's oral command. It is possible to catch the rod at a location displaced from the intended ball and then permit the vertical rod to slide through the wands until the ball rests on the wands. However, the preferred goal is to catch the rod precisely at its juncture with the underside of the desired ball, and increased proficiency towards this goal can be achieved by repeating the exercise.

Figure 10:
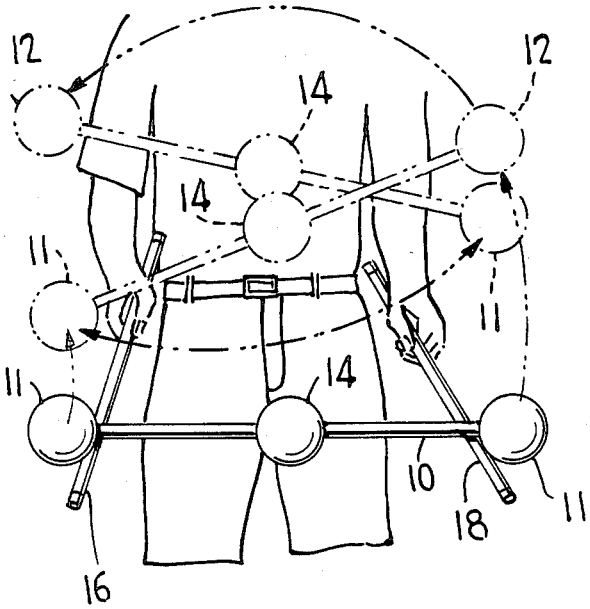
FIG. 10 is a diagrammatic illustration of an exercise that can be performed as part of the present invention with the rod of FIG. 1 starting in a horizontal orientation.

Another exercise to be performed with the present invention is begun from a position illustrated in FIG. 10 wherein the rod 10 is supported horizontally on the two spaced wands 16, 18. In this position, one wand 16 is placed at the juncture of end ball 11 and rod 10, while the other wand 18 is placed at the juncture of the other end ball 12 and rod 10. The rod may be flipped or twirled by either wand to revolve in as many turns as desired and then be caught in either a horizontal orientation (FIG. 10) or one of the vertical orientations (FIGS. 8 or 9). If the latter, the rod can also be twirled from the vertical orientation and then caught horizontally. In either case, the visible distinctiveness of the three balls (i.e., their colors) makes it possible for the user to focus on a preselected ball and catch the rod in a particular orientation. Specifically, if the rod is to be caught in a vertical orientation, the user catches the rod just below the preselected ball. If the rod is to be caught in a horizontal orientation, the user catches the rod with the specified ball at his/her right hand side or left hand side, as determined in advance. In any case, hand-eye coordination skills are readily tested and improved. The positioning of the slidable ball to vary the center of gravity of the rod, and thus change the rod trajectory when it is twirled, prevents the user from falling into a comfortable pattern with a fixed trajectory and thereby forces the user to focus on a preselected ball.

Figure 12:
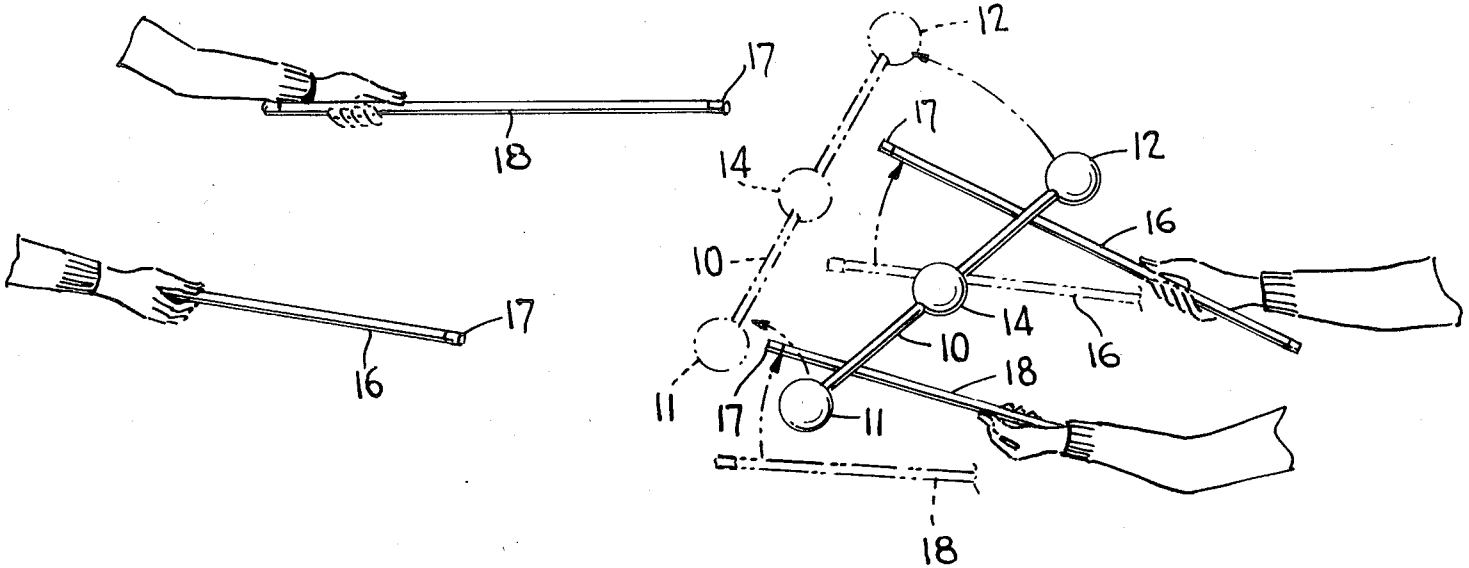
FIGS. 12 and 13 illustrate exercises that can be performed with the rod of FIG. 1 by two or more players in accordance with the principles of the present invention.
Figure 13:
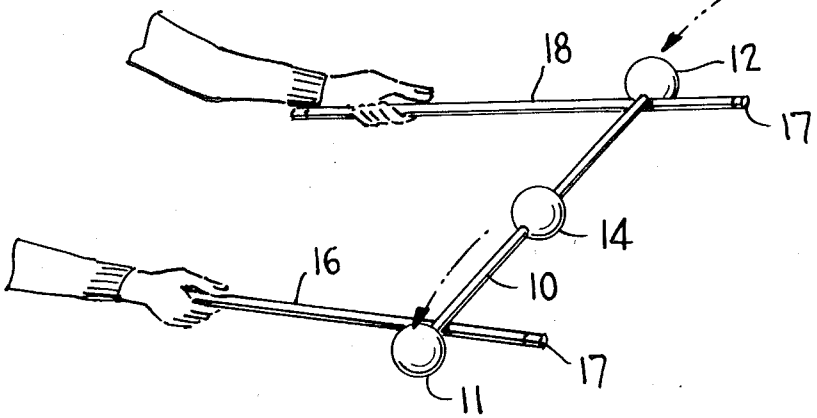

As illustrated in FIGS. 12 and 13, the present invention can be used by two or more persons, each having a pair of hand-held wands 16, 18. In the illustration, one player holds the rod 10 in a first orientation (e.g., horizontal, the position illustrated in FIG. 10) and tosses the rod, usually with one or more half revolutions, to another player who is required to catch it in a preselected orientation (i.e., horizontal or vertical, with a particular ball in a specified position). Typically, the tossing player will shout out, just before tossing the rod, the orientation and specificed ball. For example, a tossing player may call:"horizontal, red ball at right"; or"vertical, yellow ball"; or"vertical, white ball"; etc. The receiving player must catch the rod accordingly and may be awarded or lose points depending upon the success of the prescribed catch. Various rules may be established, as desired, to play the game in a variety of forms. Importantly, the players develop various hand-eye coordination skills while playing an enjoyable game.

The apparatus of the present invention may also be used to improve foot-eye skills in conjunction with hand-eye skills. In particular, the rod 10 may be suspended as illustrated in FIGS. 8 or 9 and then dropped. While the rod is falling the user may kick the lower end ball so that the rod is kicked into the air and can be caught in a prescribed orientation with the wands, either by the kicker or by another player. With proficiency gained by practice, the player can develop the ability to effect a desired number of end-over-end revolutions in the kicked rod. Similarly, the rod may be supported horizontally, as illustrated in FIG. 10, and then dropped so that the intermediate ball 14, which is preferably close to or at the rod center, may be kicked. The kicked rod may then be caught by the kicker or another player by means of the wands.

I have disclosed herein an amusement device, and methods of its use, enabling greater ocular and hand-eye skill training than is possible with prior art devices. The invention structure is simple and inexpensive to manufacture yet has extreme versatility by virtue of the slidable ball which effects a variable center of gravity for the juggled rod. I have found that my device is useful in training exercises for both adults and children and holds the interest of persons of substantially any age.

Having described the preferred embodiment of a new and improved Method and Apparatus for Juggling in accordance with the present invention, it is believed that other modifications, variations and changes will be suggested to those skilled in the art in view of the teachings set forth herein. It is therefore to be understood that all such variations, modifications and changes are believed to fall within the scope of the present invention as defined by the appended claims.

What is claimed is:

1. A twirlable amusement device for use in ocular exercise and training and for hand-eye coordination exercise and training, said device comprising:

an elongated rod of material having a smooth exterior surface with a low coefficient of friction, said rod having first and second ends and an intermediate portion disposed between said first and second ends;

first and second end members with exterior surfaces of first and second different colors, respectively, removably secured to said first and second ends, respectively, each end member having a transverse dimension at least twice as large as the transverse dimension of said rod, wherein the exterior surfaces of said first and second end members intersect the exterior surface of said rod at first and second visible junctions, respectively;

means for selectively varying the center of gravity of said rod, said means comprising a slide member slidably disposed on the smooth exterior surface of said rod to frictionally engage said intermediate portion of said rod at multiple selectible positions along the rod, said slide member having a transverse dimension at least twice as large as the transverse dimension of said rod and having an exterior surface of a third color different from said first and second colors, the exterior surface of said slide member intersecting the exterior surface of said rod at third and fourth visible junctions that are movable along said intermediate portion of the rod with said slide member; and first and second catcher/tosser means adapted to be held in first and second hands, respectively, of a user of the device to permit said rod to be engaged between said first and second catcher/tosser means alternatively at said first, second, third and fourth junctions, wherein said first and second catcher/-tosser means comprise respective first and second elongated wands each having a smooth outer surface of relatively low coefficient of friction such that the smooth outer surface of said rod slides smoothly and easily along the smooth outer surfaces of said wands when the rod is engaged between the wands.

2. The device according to claim 1 wherein said rod is a hollow cylindrical tube having a known outer diameter, wherein each of said first and second end members and said slide member are multiply-apertured hollow balls, each of said balls having an outer diameter at least twice said known diameter.

3. The device according to claim 2 wherein the outer diameter of each of said balls is at least three times said outer diameter of said rod.

4. The device according to claim 1 wherein said slide member has first and second spaced and independent objects disposed at respective first and second spaced locations on its outer surface facing said first end of said rod such that, when said rod is oriented by a user with its first end at the nose of the user and the rod extending forwardly therefrom with said first and second objects positioned on transversely opposite sides of the rod and the user's eyes are focused between said objects, the objects appear to the user to converge and diverge as the slide member is moved toward and away, respectively, from said first end.

5. The device according to claim 1 wherein said elongated rod is approximately twenty-seven inches long with an outside diameter of approximately one-half inch, and wherein said balls are approximately three inches in diameter.

6. The device according to claim 1 wherein said first and second end members and said slide member are substantially identical in size, shape, weight and orientation of apertures.

7. A twirlable amusement device for use in ocular exercise and training and for hand-eye coordination exercise and training, said device comprising:

an elongated cylindrical tubular rod of material having a smooth exterior surface with a low coefficient of friction, said rod having a known cross-sectional outside diameter, first and second ends and an intermediate portion disposed between said first and second ends;

first and second end balls having hollow interiors, each ball including multiple apertures defined therein and exterior surfaces of first and second different colors, respectively, each end ball further including an outside diameter at least twice as large as the cross-sectional outside diameter of said rod;

means removably securing said first and second end balls to said rod proximate said first and second ends, respectively, by friction fit engagement of said rod proximate said first end in a aperture of said first end ball and by friction fit engagement of said rod proximate said second end in an aperture of said second end ball, wherein said first and second rod ends terminate within the hollow interiors of said first and second end balls, respectively;

wherein the exterior surfaces of said first and second end balls intersect the exterior surface of said rod at first and second visible junctions, respectively;

an intermediate ball having multiple apertures and a hollow interior slidably disposed through two of its multiple apertures on the smooth exterior rod surface to frictionally engage said intermediate portion of said rod at multiple selectable positions along the rod length, said intermediate ball having an outside diameter at least twice as large as the known cross-sectional outside diameter of said rod and having an exterior surface of a third color different from said first and second colors, the exterior surface of said intermediate ball intersecting the exterior surface of said rod at third and fourth visible locations that are movable along said intermediate portion of the rod with said intermediate ball; and first and second catcher/tosser means adapted to be held in first and second hands, respectively, of a user of the device to permit said rod to be engaged between said first and second catcher/tosser means alternatively at said first, second, third and fourth junctions, wherein said first and second catcher/-tosser means comprise respective first and second elongated wands each having a smooth outer surface of relatively low coefficient of friction such that the smooth outer surface of said rod slides smoothly and easily along the smooth outer surfaces of said wands when the rod is engaged between the wands.

8. The device according to claim 7 wherein said intermediate ball has first and second spaced and separate objects disposed at respective first and second spaced locations on its outer surface facing said first end such that, when said rod is oriented by a user with its first end at the nose of the user and the rod extending forwardly therefrom with said first and second objects positioned on transversely opposite sides of the rod and the user's eyes are focused between said objects, the objects appear to the user to converge and diverge as the intermediate ball is moved toward and away, respectively,f rom said first end.

9. The device according to claim 7 wherein said first and second balls and said intermediate ball are substantially identical in size, shape, weight and orientation of apertures.

* * * * *